US010738717B2

(12) United States Patent
Malischewski et al.

(10) Patent No.: US 10,738,717 B2
(45) Date of Patent: Aug. 11, 2020

(54) METHOD FOR BRAKING AN INTERNAL COMBUSTION ENGINE

(71) Applicant: MAN Truck & Bus AG, Munich (DE)

(72) Inventors: Thomas Malischewski, Heilsbronn (DE); Dominik Renner, Ansbach (DE)

(73) Assignee: MAN TRUCK & BUS AG, Munich (DE)

( * ) Notice: Subject to any disclaimer, the term of this patent is extended or adjusted under 35 U.S.C. 154(b) by 71 days.

(21) Appl. No.: 16/119,211

(22) Filed: Aug. 31, 2018

(65) Prior Publication Data

US 2019/0072042 A1 Mar. 7, 2019

(30) Foreign Application Priority Data

Sep. 1, 2017 (DE) ..... 10 2017 120 150

(51) Int. Cl.
*F02D 13/04* (2006.01)
*F01L 13/00* (2006.01)
(Continued)

(52) U.S. Cl.
CPC ..... *F02D 13/04* (2013.01); *F01L 13/0042* (2013.01); *F01L 13/065* (2013.01); *F02D 13/0246* (2013.01); *F01L 2760/003* (2013.01); *F02D 13/0257* (2013.01); *F02D 41/12* (2013.01); *F02D 2041/001* (2013.01); *F02D 2200/101* (2013.01)

(58) Field of Classification Search
CPC .. F02D 13/04; F02D 13/0246; F02D 13/0257; F02D 41/12; F02D 2041/001; F02D 2200/101; F02D 13/0249; F02D 13/0215; F01L 13/065; F01L 13/0042; F01L 2760/003
See application file for complete search history.

(56) References Cited

U.S. PATENT DOCUMENTS 3,786,792 A 1/1974 Pelizzoni et al.
4,592,319 A 6/1986 Meistrick
(Continued)

FOREIGN PATENT DOCUMENTS

DE 3922884 A1 1/1991
DE 19649174 A1 6/1997
(Continued)

*Primary Examiner* — Thomas N Moulis
(74) *Attorney, Agent, or Firm* — Weber Rosselli & Cannon LLP

(57) ABSTRACT

The present disclosure relates to a method for braking of an internal combustion engine, in particular a four-stroke internal combustion engine. The method involves a partial opening of at least one gas discharge valve of at least one cylinder of the internal combustion engine during a compression stroke of the internal combustion engine. The method involves a holding of a partial opening of the at least one gas discharge valve during an expansion stroke of the internal combustion engine following the compression stroke and during an exhaust stroke of the internal combustion engine following the expansion stroke. The method involves a closing of the partly opened at least one gas discharge valve at the end of the exhaust stroke or during an intake stroke of the internal combustion engine following the exhaust stroke.

17 Claims, 2 Drawing Sheets

(51) Int. Cl.

| | |
|---|---|
| ***F01L 13/06*** | (2006.01) |
| ***F02D 13/02*** | (2006.01) |
| *F02D 41/00* | (2006.01) |
| *F02D 41/12* | (2006.01) |

(56) References Cited

U.S. PATENT DOCUMENTS

| | | | | |
|---|---|---|---|---|
| 5,647,319 | A | 7/1997 | Uehara et al. | |
| 6,269,793 | B1 * | 8/2001 | Russ | F02D 13/0219 123/325 |
| 2002/0174654 | A1 | 11/2002 | Yang | |
| 2004/0187842 | A1 * | 9/2004 | Yang | F01L 1/08 123/322 |
| 2004/0231639 | A1 * | 11/2004 | Israel | F01L 1/08 123/321 |
| 2005/0284435 | A1 | 12/2005 | Baeuerle | |
| 2008/0210197 | A1 * | 9/2008 | Smith | F02D 9/06 123/321 |
| 2010/0006062 | A1 * | 1/2010 | Yang | F01L 1/181 123/321 |
| 2011/0197833 | A1 * | 8/2011 | Vorih | F01L 1/08 123/90.12 |
| 2013/0319370 | A1 * | 12/2013 | Yang | F01L 1/08 123/322 |
| 2014/0373808 | A1 * | 12/2014 | Ernest | F02D 13/04 123/321 |

FOREIGN PATENT DOCUMENTS

| | | | |
|---|---|---|---|
| DE | 19637998 | A1 | 3/1998 |
| DE | 102005033163 | A1 | 2/2006 |
| DE | 102005059403 | A1 | 6/2007 |
| DE | 102013019183 | A1 | 5/2015 |
| DE | 102015016526 | A1 | 6/2017 |
| EP | 0294682 | A1 | 12/1988 |

* cited by examiner

METHOD FOR BRAKING AN INTERNAL COMBUSTION ENGINE

BACKGROUND

The present disclosure relates to a method for braking of an internal combustion engine and a motor vehicle with a variable valve train for implementing the method.

Such a method is described by DE 39 22 884 A1, in which in the engine brake operation, besides the closing of a flap gate in the exhaust tract, a decompression effect significantly boosting the engine brake effect is achieved in that the outlet valves (inlet valves unchanged) are partly opened during each compression stroke by intervening in the valve controls of the internal combustion engine and in this way the air taken in during the intake stroke into the cylinder is decompressed by being blown into the exhaust tract. Moreover, the outlet valves are fully opened in normal operation during each exhaust stroke, i.e., with almost no decompression effect.

Examples of further methods for braking an internal combustion engine are disclosed in DE 10 2015 016 526 A1, DE 10 2005 033 163 A1, DE 196 49 174 A1 and U.S. Pat. No. 4,592,319 A.

Specifically, DE 10 2013 019 183 A1 discloses a method for controlling the engine brake effect of a valve-controlled internal combustion engine, especially a four-stroke internal combustion engine, for motor vehicles, wherein besides an exhaust gas accumulation in the exhaust gas line by closing a flap gate, a decompression effect is generated by partial, in particular irregular opening of at least one outlet valve per cylinder of the internal combustion engine. The at least one outlet valve is opened in the compression stroke and in the exhaust stroke, possibly with overlapping. In order to heighten the engine brake effect, the at least one outlet valve or at least one of the outlet valves is opened with a defined predetermined lesser valve stroke and/or one which is less than a regular valve stroke each time in the TDC region of the piston between the compression stroke and the expansion stroke and between the exhaust stroke and the intake stroke.

The potential drawback to the method known from DE 10 2013 019 183 A1 is that an unwanted engine excitation may occur at low engine speeds on account of the compressing of the gas in the exhaust stroke, for example when not all cylinders are being operated in the engine brake operation. This engine excitation may result in unwanted oscillations in the drive train.

SUMMARY

The present disclosure further modifies in particular the method disclosed in DE 10 2013 019 183 A1 for controlling the engine brake effect. Thus, the problem which the present disclosure proposes to solve is to provide an improved method for braking an internal combustion engine.

The method is suitable for the braking of an internal combustion engine, in particular a four-stroke internal combustion engine. The method involves a partial opening of at least one gas discharge valve of at least one cylinder of the internal combustion engine during a compression stroke of the internal combustion engine.

The method involves a holding of a partial opening of the at least one gas discharge valve during an expansion stroke of the internal combustion engine following the compression stroke and during an exhaust stroke of the internal combustion engine following the expansion stroke. The method involves a closing of the partly opened at least one gas discharge valve at the end (in the TDC region) of the exhaust stroke or during an intake stroke of the internal combustion engine following the exhaust stroke.

The method utilizes the gas dynamics of the gas flowing out from the combustion chambers of the internal combustion engine through the gas discharge valve or valves. The partial opening of the gas discharge valve during the expansion stroke and the exhaust stroke results in highly different cylinder pressure curves, depending on the engine speed of the internal combustion engine. This makes it possible to adjust different desirable cylinder pressure curves and thus engine brake effects for different engine speeds. In particular, at low revolutions, only a compressing and decompressing can occur in the region of the compression stroke. At higher revolutions, on the other hand, a first compressing and a first decompressing may occur in the compression stroke and a second compressing and a second decompressing in the exhaust stroke. Thus, in particular, the above mentioned drawback of the unwanted engine excitation at low engine speeds can be avoided owing to a compressing with subsequent decompressing in the exhaust stroke. This effect is accomplished in that always the same flow cross section is provided by the partly opened gas discharge valve, but this is larger for the gas at the available outflow time during low engine speeds than during high engine speeds.

The at least one gas discharge valve may be provided upstream from an exhaust tract of the internal combustion engine.

In one embodiment, the at least one gas discharge valve during the partial opening is opened so far that basically no compressing occurs in the respective cylinder during the exhaust stroke at a speed of the internal combustion engine below a limit speed of the internal combustion engine. Specifically, a flow cross section, defined by a valve gap of the at least one partly opened gas discharge valve, can be adjusted so that, below the limit speed, there is basically no compressing and thus no engine brake effect on account of the compressing in the respective cylinder during the exhaust stroke. In other words, the flow cross section is sufficient, at a comparatively low piston velocity with low engine speed, to expel the gas substantially with no compressing in the cylinder through the partly opened gas discharge valve.

In a further embodiment, the at least one gas discharge valve during the partial opening is opened so far that a compressing occurs in the respective cylinder during the exhaust stroke at a speed of the internal combustion engine above the limit speed. Specifically, the flow cross section, defined by the valve gap of the at least one partly opened gas discharge valve, can be adjusted so that, above the limit speed, there occurs the compressing and thus the engine brake effect in the respective cylinder during the exhaust stroke. Hence, the desired high engine brake effect at high engine speeds can be achieved above the limit speed. In other words, the flow cross section is dimensioned such that, at a comparatively high piston velocity with high engine speed, the gas cannot be expelled without a pressure increase in the cylinder through the partly opened gas discharge valve.

In one embodiment, the compressing in the respective cylinder increases with increasing speed of the internal combustion engine above the limit speed in the exhaust stroke.

In another embodiment, the limit speed lies in a region between 1000 rpm and 1700 rpm, especially in a region between 1200 rpm and 1500 rpm.

The limit speed can be chosen such that the speed range below the limit speed is the region in which the aforementioned detrimental engine excitation would occur due to a compressing in the exhaust stroke.

In one embodiment, the at least one gas discharge valve is opened during the partial opening in a region between 5% and 30% of a maximum valve stroke of the at least one gas discharge valve. Alternatively or additionally, the at least one gas discharge valve is opened during the partial opening in a region between 0.5 mm and 3 mm.

In another embodiment, a maximum valve stroke lies in a region between 10 mm and 16 mm.

In a further embodiment, the partial opening of the at least one gas discharge valve during the compression stroke starts in a region between 100° crankshaft angle and 60° crankshaft angle before TDC (top dead centre of a movement of a piston of the respective cylinder). Hence, the gas present in the combustion chamber is at first compressed and only at the end of the compression stroke is it expelled by the partly opening at least one gas discharge valve into the exhaust tract, accomplishing a decompression effect.

In another embodiment, the closing of the at least one gas discharge valve at the end of the exhaust stroke or during the intake stroke begins in a region between TDC (top dead centre of a movement of a piston of the respective cylinder) and 30° crankshaft angle after TDC. Hence, the gas flowing back into the combustion chamber from the exhaust tract during the expansion stroke, depending on an engine speed in the exhaust stroke, may either be expelled again directly into the exhaust tract by the at least partly opened gas discharge valve or, at higher engine speeds, it may be at least partly compressed and only then expelled through the at least partly opened gas discharge valve. Thus, at higher speeds, a further compression of the gas in the combustion chamber may occur in the exhaust stroke, followed by decompression of the compressed gas into the exhaust tract, thereby increasing an engine brake effect of the method.

In particular, the closing of the at least one gas discharge valve may overlap with an opening of at least one gas admission valve.

In one embodiment, during the holding open of the gas discharge valve during the expansion stroke and the exhaust stroke, a constant valve stroke of the at least one gas discharge valve is maintained. This is especially easy to control, for example, by maintaining the height of a cam of a camshaft.

In another embodiment, two gas discharge valves are provided for each cylinder and only one of the two gas discharge valves is partly opened during the compression stroke, held open with a partial opening during the expansion stroke and the exhaust stroke, and closed at the end of the exhaust stroke or during the intake stroke. In addition, the other of the two gas discharge valves may be closed during the compression stroke, the expansion stroke, the exhaust stroke and the intake stroke. In this way, the loads on the variable valve train associated with the gas discharge valves can be lessened, since in particular only one of the gas discharge valves of each cylinder needs to be opened against the pressure in the combustion chamber during the compression stroke.

In yet a further embodiment, the method involves an opening of at least one gas admission valve of the at least one cylinder during an intake stroke and a holding closed of the at least one gas admission valve during the compression stroke, the expansion stroke and the exhaust stroke. In this way, the gas inlet valves during the engine brake operation of the internal combustion engine can be activated as in the normal operation of the internal combustion engine. Thus, the activation of the gas inlet valves does not need to be changed for the engine brake operation. As in normal operation, the gas inlet valves in the engine brake operation are used to conduct air from an air supply system of the internal combustion engine during the intake stroke into the combustion chambers.

The method may further involve a closing of a flap gate situated downstream from the at least one gas discharge valve during the compression stroke and/or during the exhaust stroke. The flap gate may preferably be arranged in the exhaust tract.

The present disclosure also relates to a variable valve train for an internal combustion engine. The variable valve train may be designed especially as a sliding cam system. The variable valve train is adapted to carry out the method as disclosed herein.

In addition, the present disclosure also relates to a motor vehicle, especially a commercial vehicle (such as a bus or a lorry), with an internal combustion engine having the variable valve train as disclosed herein.

It is also possible to employ the method as disclosed herein for passenger cars, large engines, all-terrain vehicles, stationary engines, marine engines, and so forth.

The previously described embodiments and features of the present disclosure may be combined with each other in any desired manner.

BRIEF DESCRIPTION OF THE DRAWINGS

Further details and benefits of the present disclosure are described below with reference to the accompanying figures. There are shown.

DETAILED DESCRIPTION

Figure 1:
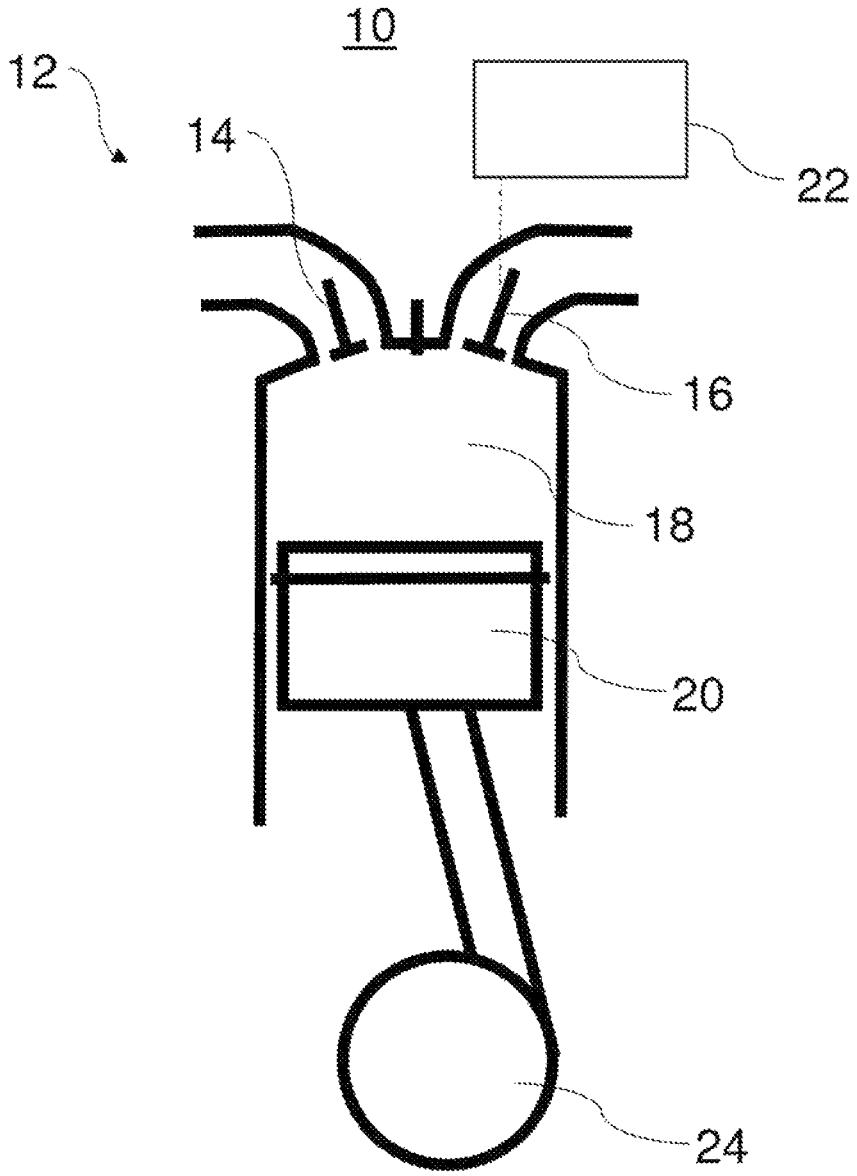
FIG. 1 a diagram of a cylinder of an internal combustion engine.

FIG. 1 shows a cylinder 12 of an internal combustion engine 10. The internal combustion engine 10 is a four-stroke internal combustion engine, especially a four-stroke Diesel internal combustion engine or a four-stroke gasoline internal combustion engine. Preferably, the internal combustion engine 10 is contained in a commercial vehicle, such as a lorry or a bus, for the propelling of the commercial vehicle.

The cylinder 12 comprises at least one gas admission valve 14, at least one gas discharge valve 16, one combustion chamber 18 and one piston 20.

The at least one gas admission valve 14 connects the combustion chamber 18 to an air supply system of the internal combustion engine 10 for the feeding of combustion air into the combustion chamber 18. The at least one gas discharge valve 16 connects the combustion chamber 18 to an exhaust gas line of the internal combustion engine 10 to take away the exhaust gases. For example, two gas inlet valves 14 and two gas discharge valves 16 per cylinder 12 and a plurality of cylinders 12 may be provided.

The at least one gas discharge valve 16 may be activated by a variable valve train 22. The variable valve train 22 may be designed, for example, as a sliding cam system. The sliding cam system may comprise at least one cam carrier with at least two cams. The cam carrier may be arranged in torque-proof and axially displaceable manner on a camshaft. The at least one gas exchange valve is activated in dependence on an axial position of the cam carrier by various cams of the cam carrier. It is also possible, in the case of multiple gas discharge valves 16 for each cylinder 12, that the gas discharge valves 16 of the respective cylinder 12 can be activated in different manner.

The piston 20 is arranged in the cylinder 12, in reciprocating movement in a known manner, and connected to a crankshaft 24.

Figure 2:
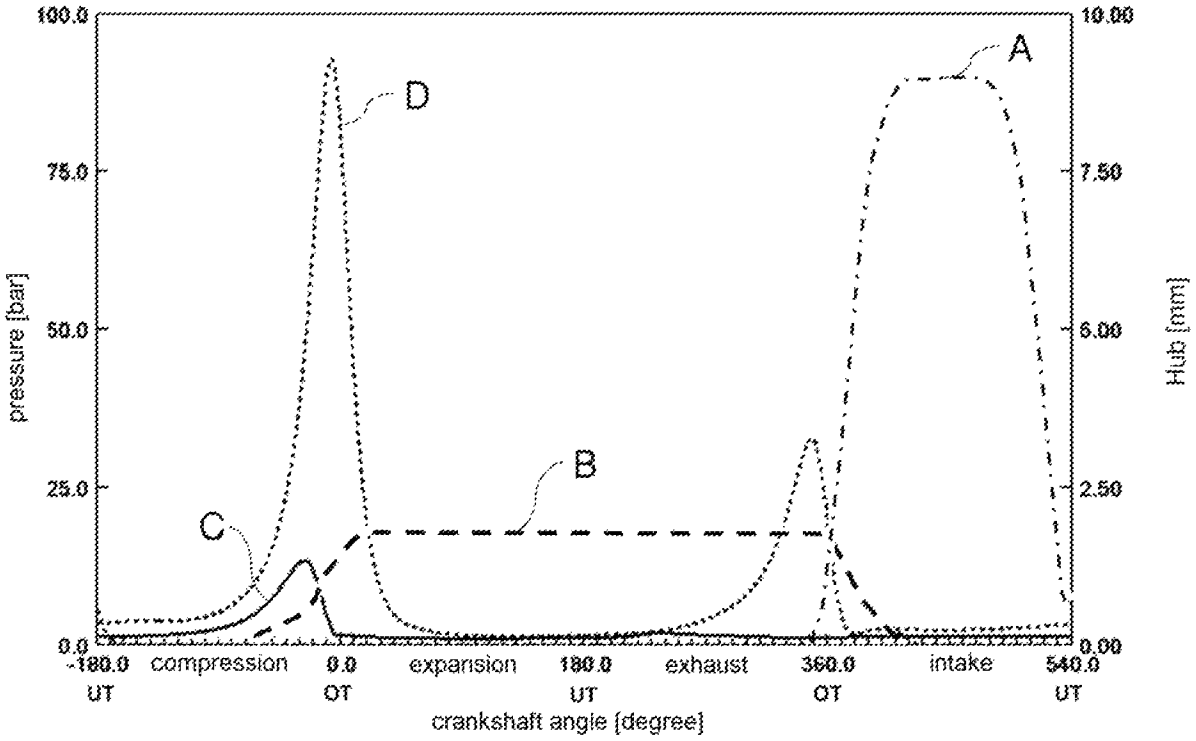
FIG. 2 a control diagram of a valve control system of a four-stroke internal combustion engine.

FIG. 2 shows an exemplary control diagram for the activation of the gas inlet valves 14 and the gas discharge valves 16 of FIG. 1 during an engine brake operation of the internal combustion engine 10.

A dot and dash curve A shows a valve stroke of the gas inlet valves 14 as a function of a crankshaft angle of the crankshaft 24. A dash curve B shows a valve stroke of the gas discharge valve 16 as a function of the crankshaft angle of the crankshaft 24. A solid curve C shows a cylinder pressure in the combustion chamber 18 as a function of a crankshaft angle of the crankshaft 24 at a low engine speed. A dotted curve D shows a cylinder pressure in the combustion chamber 18 as a function of a crankshaft angle of the crankshaft 24 at a high engine speed.

Curves A to D are plotted against the usual 720° crankshaft angle (CA) in four-stroke operation, the left axis of the diagram indicating the cylinder pressures in bar and the right axis the valve strokes in mm.

According to curve A, the gas inlet valves 14 are opened during the engine brake operation during the intake stroke, the same as in regular operation. During the further control cycle, the gas inlet valves 14 are closed.

During the engine brake operation, the gas discharge valves 16 are controlled other than in the regular operation (normal operation), in which the gas discharge valves 16 are only opened during the exhaust stroke. For example, the internal combustion engine may have two gas discharge valves 16 per cylinder 12, one of which is held fully closed during the engine brake operation and the other is controlled according to curve B during the engine brake operation.

According to curve B, the gas discharge valve 16 is partly opened by roughly 60° CA to 100° CA before the ignition top dead centre, i.e., before the end of the compression stroke. The gas discharge valve 16 is then held partly open for approximately 360° CA during the expansion stroke and the exhaust stroke. The partly opened gas discharge valve 16 is again closed after the exhaust stroke and remains closed until the next opening in the compression stroke.

The gas discharge valve 16 is only partly opened, per curve B. The partial opening may correspond to a valve stroke of 0.5 mm to 3 mm. On the contrary, a maximum stroke (regular stroke) of the gas discharge valve 16 may be for example between around 10 mm for small internal combustion engines 10 and up to around 16 mm for very large internal combustion engines 10 in commercial vehicle construction.

Owing to the only partial opening of the gas discharge valve 16 per curve B, different cylinder pressure curves may be achieved in the combustion chamber 18 at different speeds of the internal combustion engine 10.

According to curve C, at low speeds of the internal combustion engine 10 up to around 1200 rpm, for example, no compressing occurs in the combustion chamber 18 during the exhaust stroke. The reason for this is the valve gap due to the partly opened gas discharge valve 16. This valve gap at low velocities of the piston 20 is enough to allow the gas present in the combustion chamber 18 to flow out from the combustion chamber 18 through the partly opened gas discharge valve 16 with no pressure increase. Curve C for example relates to a cylinder pressure curve at an engine speed of the internal combustion engine of around 600 rpm.

On the other hand, according to curve D at high speeds of the internal combustion engine 10 from 1200 rpm to 1500 rpm, for example, there occurs a compressing in the combustion chamber 18 during the exhaust stroke. Owing to the increased engine speed, the piston velocity of the piston 20 also rises and the volume flow across the partly opened gas discharge valve 16 likewise increases. The valve gap provided by the partly opened gas discharge valve 16 is no longer sufficient to expel the gas without compression. Instead, there occurs a second compression before the top dead centre at the end of the exhaust stroke. During the second compression, compression energy is dissipated through the still opened gas discharge valve 16 and braking power is generated. Specifically, the compression work brakes the piston 20, thereby braking the internal combustion engine 10 in the engine brake operation. Curve D pertains, for example, to a cylinder pressure curve at an engine speed of the internal combustion engine of around 2600 rpm.

For both curves C and D there occurs a first compression in the combustion chamber 18 during the compression stroke, since the gas discharge valve 16 is opened only toward the end of the compression stroke. The opening of the gas discharge valve 16 produces a decompression of the compressed gas in the exhaust tract, in which there is provided for example a flap gate which is closed at this time. The compression work performed by the piston 20 once again brakes the internal combustion engine 10. Due to the higher piston velocity of the piston 20, per curve D, there occurs a greater compression in the combustion chamber 18 at higher engine speeds and thus a greater braking effect than at low engine speed per curve C.

During the expansion stroke, the cylinder pressures for curves C and D are low and due to the exhaust gas accumulation in the exhaust tract air can flow from the exhaust tract back into the combustion chamber 18 through the partly opened gas discharge valve 16.

Summarizing, at low engine speed below a limit speed, which lies e.g. between 1200 rpm and 1500 rpm, per curve C, there occurs only a compression of gas in the combustion chamber 18 and a decompression of the compressed gas in the exhaust tract. This onetime compression-decompression occurs in the compression stroke. At a high engine speed above the limit speed, with the same control curve (curve B) for the same gas discharge valve 16 as per curve D, there occurs a double compression of gas in the combustion chamber 18 and decompression of the compressed gas in the exhaust tract through the partly opened gas discharge valve 16. On the one hand, in the compression stroke there occurs a first compression followed by decompression. In addition, in the exhaust stroke there occurs a second compression followed by decompression.

A transition between curves C and D occurs steadily with increasing engine speed of the internal combustion engine 10.

The present disclosure thus makes it possible to accomplish a high braking effect due to the double compression-decompression with the identical control profile for a gas discharge valve 16 at high speeds of the internal combustion engine 10 (curve D). At low speeds, likewise a (lesser) braking effect is accomplished by the single compression-decompression (curve C), while an engine excitation is prevented or at least reduced on account of eliminating the second compression-decompression. Thus, the behaviour is automatically adapted to the surrounding conditions (the engine speed), so that no additional control intervention from the outside is required.

The present disclosure is not confined to the above described preferred exemplary embodiments. Instead, many variants and modifications are possible, which likewise make use of the idea of the present disclosure and therefore come under the scope of protection. In particular, the present disclosure is also directed to the partial opening of at least one gas discharge valve during a compression stroke, the holding of a partial opening of the at least one gas discharge valve during an expansion stroke and/or exhaust stroke and/or the closing of the partly opened at least one gas discharge valve at the end of the exhaust stroke or during an intake stroke.

LIST OF REFERENCE NUMBERS

10 Internal combustion engine
12 Cylinder
14 Gas admission valve
16 Gas discharge valve
18 Combustion chamber
20 Piston
22 Variable valve train
24 Crankshaft
A Control curve for gas admission valve
B Control curve for gas discharge valve
C Cylinder pressure curve at low engine speed
D Cylinder pressure curve at high engine speed

We claim:

1. A method for braking of an internal combustion engine, comprising:

partially opening at least one gas discharge valve of at least one cylinder of an internal combustion engine during a compression stroke of the internal combustion engine;

holding a partial opening of the at least one gas discharge valve during an expansion stroke of the internal combustion engine following the compression stroke and during an exhaust stroke of the internal combustion engine following the expansion stroke; and closing the partially opened at least one gas discharge valve at the end of the exhaust stroke or during an intake stroke of the internal combustion engine following the exhaust stroke, wherein during the partial opening the at least one gas discharge valve is opened so far that basically no compressing occurs in the respective cylinder during the exhaust stroke at a speed of the internal combustion engine below a limit speed of the internal combustion engine, wherein during the partial opening the at least one gas discharge valve is opened so far that a compressing occurs in the respective cylinder during the exhaust stroke at a speed of the internal combustion engine above the limit speed, and wherein the limit speed lies in a region between 1000 rpm and 1700 rpm.

2. The method according to claim 1, wherein the combustion engine is a four-stroke internal combustion engine.

3. The method according to claim 1, wherein the compressing in the respective cylinder increases with increasing speed of the internal combustion engine above the limit speed in the exhaust stroke.

4. The method according to claim 1, wherein the limit speed lies in a region between 1200 rpm and 1500 rpm.

5. The method according to claim 1, wherein the at least one gas discharge valve is opened during the partial opening in a region between 5% and 30% of a maximum valve stroke of the at least one gas discharge valve.

6. The method according to claim 5, wherein a maximum valve stroke lies in a region between 10 mm and 16 mm.

7. The method according to claim 1, wherein partially opening the at least one gas discharge valve during the compression stroke starts in a region between 100° crankshaft angle and 60° crankshaft angle before top dead centre (TDC).

8. The method according to claim 1, wherein closing the at least one gas discharge valve at the end of the exhaust stroke or during the intake stroke begins in a region between top dead centre (TDC) and 30° crankshaft angle after TDC.

9. The method according to claim 1, wherein during the holding open of the gas discharge valve during the expansion stroke and the exhaust stroke, a constant valve stroke of the at least one gas discharge valve is maintained.

10. The method according to claim 1, wherein two gas discharge valves are provided for each cylinder and only one of the two gas discharge valves is partially opened during the compression stroke, held open with a partial opening during the expansion stroke and the exhaust stroke, and closed at the end of the exhaust stroke or during the intake stroke.

11. The method according to claim 10, wherein the other of the two gas discharge valves is closed during the compression stroke, the expansion stroke, the exhaust stroke, and the intake stroke.

12. The method according to claim 1, further comprising:

opening at least one gas admission valve of the at least one cylinder during an intake stroke; and holding the at least one gas admission valve closed during the compression stroke, the expansion stroke, and the exhaust stroke.

13. A variable valve train for an internal combustion engine, the variable valve train adapted to brake the internal combustion engine by performing a method, comprising:

partially opening at least one gas discharge valve of at least one cylinder of the internal combustion engine during a compression stroke of the internal combustion engine;

holding a partial opening of the at least one gas discharge valve during an expansion stroke of the internal combustion engine following the compression stroke and during an exhaust stroke of the internal combustion engine following the expansion stroke; and closing the partially opened at least one gas discharge valve at the end of the exhaust stroke or during an intake stroke of the internal combustion engine following the exhaust stroke, wherein during the partial opening the at least one gas discharge valve is opened so far that basically no compressing occurs in the respective cylinder during the exhaust stroke at a speed of the internal combustion engine below a limit speed of the internal combustion engine, wherein during the partial opening the at least one gas discharge valve is opened so far that a compressing occurs in the respective cylinder during the exhaust stroke at a speed of the internal combustion engine above the limit speed, and wherein the limit speed lies in a region between 1000 rpm and 1700 rpm.

14. The variable valve train of claim 13, wherein the variable valve train is a sliding cam system.

15. A motor vehicle, comprising:

an internal combustion engine;

a variable valve train, the variable valve train adapted to brake the internal combustion engine by performing a method, comprising:

partially opening at least one gas discharge valve of at least one cylinder of the internal combustion engine during a compression stroke of the internal combustion engine;

holding a partial opening of the at least one gas discharge valve during an expansion stroke of the internal combustion engine following the compression stroke and during an exhaust stroke of the internal combustion engine following the expansion stroke; and closing the partially opened at least one gas discharge valve at the end of the exhaust stroke or during an intake stroke of the internal combustion engine following the exhaust stroke, wherein during the partial opening the at least one gas discharge valve is opened so far that basically no compressing occurs in the respective cylinder during the exhaust stroke at a speed of the internal combustion engine below a limit speed of the internal combustion engine, wherein during the partial opening the at least one gas discharge valve is opened so far that a compressing occurs in the respective cylinder during the exhaust stroke at a speed of the internal combustion engine above the limit speed, and wherein the limit speed lies in a region between 1000 rpm and 1700 rpm.

16. The motor vehicle of claim 15, wherein the motor vehicle is a utility vehicle.

17. The method according to claim 1, wherein the at least one gas discharge valve is opened during the partial opening in a region between 0.5 mm and 3 mm.

* * * * *